US005333535A

United States Patent [19]

Miyamoto et al.

[11] Patent Number: 5,333,535

[45] Date of Patent: Aug. 2, 1994

[54] RODLESS CYLINDER

[75] Inventors: Michikazu Miyamoto; Hideho Koyama; Naoki Hoshi, all of Ibaraki, Japan

[73] Assignee: SMC Kabushiki Kaisha, Tokyo, Japan

[21] Appl. No.: 53,675

[22] Filed: Apr. 29, 1993

[30] Foreign Application Priority Data

| | | | |
|---|---|---|---|
| Jul. 21, 1992 | [JP] | Japan | 4-194286 |
| Jul. 21, 1992 | [JP] | Japan | 4-194287 |
| Jul. 22, 1992 | [JP] | Japan | 4-051465[U] |
| Aug. 21, 1992 | [JP] | Japan | 4-223006 |
| Aug. 31, 1992 | [JP] | Japan | 4-060911[U] |
| Sep. 24, 1992 | [JP] | Japan | 4-066510[U] |

[51] Int. Cl.[5] ..... F01B 29/00

[52] U.S. Cl. ..... 92/88; 92/146; 92/161; 277/DIG. 7

[58] Field of Search ..... 92/88, 146, 161; 277/DIG. 7

[56] References Cited

U.S. PATENT DOCUMENTS

| | | | |
|---|---|---|---|
| 4,373,427 | 2/1983 | Garlapaty et al. . | |
| 4,664,020 | 5/1987 | Kaiser . | |
| 5,111,913 | 5/1992 | Granbom | 92/88 |
| 5,138,935 | 8/1992 | Granbom | 92/88 |

FOREIGN PATENT DOCUMENTS

| | | | |
|---|---|---|---|
| 0177850 | 5/1986 | European Pat. Off. . | |
| 0294350 | 12/1988 | European Pat. Off. . | |
| 0345506 | 12/1989 | European Pat. Off. | 92/88 |
| 0442859 | 8/1991 | European Pat. Off. . | |
| 3124915 | 1/1983 | Fed. Rep. of Germany . | |
| 4024716 | 2/1992 | Fed. Rep. of Germany . | |
| 1247812 | 10/1989 | Japan | 92/88 |
| 3004005 | 1/1991 | Japan | 92/88 |

OTHER PUBLICATIONS

*Tol-o-matic* sales brochure pp. 9-10 dated Dec. 1987.

*Primary Examiner*—Thomas E. Denion

*Attorney, Agent, or Firm*—Oblon, Spivak, McClelland, Maier & Neustadt

[57] ABSTRACT

A rodless cylinder for feeding a workpiece has a cylinder having a cylinder tube with a bore defined therein and a piston reciprocally movably disposed in the bore. The cylinder tube has a slit defined therein and extending longitudinally therealong, the slit communicating between the bore and an exterior space. The slit is closed by a first seal member engaging the piston and a second seal member engaging a slide table. The piston has a separator separating the first and second seal members from each other. The cylinder tube has a pair of slanted first surfaces positioned one on each side of the slit. A pair of slide members is disposed on the slide table and have respective second surfaces engaging the first surfaces, respectively, for guiding the slide table when the piston reciprocally moves in the bore and bearing a load applied to the slide table. The rodless cylinder may additionally have a floating mechanism mounted on the slide table for allowing displacements substantially perpendicular to the direction in which the slide table is movable along the cylinder tube.

16 Claims, 19 Drawing Sheets

RODLESS CYLINDER

BACKGROUND OF THE INVENTION

1. Field of the Invention

The present invention relates to a rodless cylinder that is capable of operating smoothly while effectively bearing loads applied in a variety of directions.

2. Description of the Prior Art

Discussion of the Background

Various rodless cylinders have recently found wide use as workpiece feeders in factories or the like.

The rodless cylinders take up a smaller space and can be handled with greater ease than cylinders with rods because the stroke of the rodless cylinders may be shorter. Since dust or foreign matter is prevented from entering rodless cylinders more effectively than cylinders with rods, the rodless cylinders are capable of positioning workpieces with higher accuracy.

U.S. Pat. No. 4,373,427 and German patent No. 3,124,915, for example, disclose rodless cylinders. The rodless cylinder disclosed in German patent No. 3,124,915 has guide grooves defined between an outer circumferential surface of a cylinder tube and an upper surface of a cylinder with a slit defined therein, and guide means engaging in the guide grooves, the guide means being mounted on legs extending from opposite ends of a slide table to side surfaces of the cylinder tube.

More specifically, the rodless cylinder of this type has a cylinder and a piston reciprocally movable in a bore defined in the cylinder, and includes a slide table coupled to the piston and slidable in the longitudinal direction of the piston. The cylinder has a slit defined in its upper surface which provides communication between the bore and the exterior of the cylinder along the direction in which the slide table is movable. The slit is closed by two seal members engaging the piston and the slide table. A resin-made separator is used to separate the seal member engaging the piston from the seal member engaging the slide table. A magnet is attached to an outer circumferential surface o#a piston yoke for detecting the position of the piston when the slide table to which a workpiece is clamped is slidingly displaced along the slit. The magnet is held on the outer circumferential surface of the piston yoke by a magnet holder. The position of the piston is detected when a magnetic field produced by the magnet is detected by a magnetic sensor that is mounted on the outer circumferential surface of the cylinder.

According to the rodless cylinder disclosed in German patent No. 3,124,915, however, the legs from the slide table have to extend outwardly from the outer side surfaces of the cylinder tube for holding the guide means. When the guide means engage the cylinder tube at the time a lateral force is applied, one end surface of the cylinder tube which defines the slit is forcibly brought toward the other end surface of the cylinder tube which also defines the slit. Therefore, the inside diameter of the bore is reduced as a whole, forcing the piston to stop. Therefore, the application of a lateral force causes the piston to stop. When this occurs, the workpiece is unexpectedly brought to a stop, bringing about a highly dangerous condition.

The rodless cylinder has a joint which couples the piston in the cylinder tube to the slide table disposed outside of the cylinder tube, the joint extending into the bore through the slit in the cylinder tube. Thus, upon reciprocating movement of the piston and the slide table in unison with each other, if the slide table is tilted under external forces, an inner wall surface of the cylinder tube and the joint are liable to contact each other. The cylinder tube and the joint are made of a metal such as aluminum or the like. Therefore, when the inner wall surface of the cylinder tube and the joint contact each other and slide against each other, the abrasive sliding engagement tends to wear off metal particles or cause seizure, preventing the slide table from smoothly moving back and forth.

Furthermore, inasmuch as the magnet for detecting the position of the piston is attached to the outer circumferential surface of the piston yoke, the outer circumferential surface of the piston yoke must be machined to provide a recess for holding the magnet. The magnetic sensor for detecting the magnetic field from the magnet is usually disposed on the outer circumferential surface of the cylinder tube. Consequently, the magnet is required to be mounted in the vicinity of the magnetic sensor. Heretofore, it has been necessary to combine the magnetic poles of a pair of magnets for producing a strong magnetic field. For example, the two magnets each having N and S poles are arranged in a slightly staggered relationship to provide a magnetic path of N-S-N-S for generating a strong magnetic field. However, the two magnets may sometimes be arranged to provide a wrong magnetic path of N-S-S-N, for example. If the magnets are placed in the recess in a wrong orientation when the rodless cylinder is assembled, then the magnets fail to produce a desired strong magnetic field.

SUMMARY OF THE INVENTION

It is an object of the present invention to provide a rodless cylinder which has a cylinder tube with a bore defined therein whose inside diameter is prevented from varying under laterally applied loads to a slide table, which has a piston coupled to a slide table by a joint that is prevented from contacting inner wall surfaces of the cylinder tube which define a slit, thus preventing the piston from being stopped, which has magnets for detecting the position of the piston, the magnets being insertable in position without error, and which has a piston yoke that is not required to be machined for supporting the magnets, and which is relatively simple in structure, small in size, and inexpensive to manufacture.

According to the present invention, there is provided a rodless cylinder comprising a cylinder having a cylinder tube with a bore defined therein and a piston reciprocally movably disposed in the bore, the cylinder tube having a slit defined therein and extending longitudinally therealong, the slit communicating between the bore and an exterior space, a slide table, a first seal member engaging the piston, a second seal member engaging the slide table, the slit being closed by the first and second seal members, the piston having a separator for separating the first and second seal members from each other, the cylinder tube having a pair of slanted first surfaces positioned one on each side of the slit, and at least a pair of slide members disposed on the slide table and having respective second surfaces engaging the first surfaces, respectively, for guiding the slide table when the piston reciprocally moves in the bore and bearing a load applied to the slide table.

The first surfaces may be inclined from the slit toward the slide table, the second surfaces being inclined complementarily to the first surfaces.

The rodless cylinder may further include a pair of other slide members disposed outwardly of the slide members disposed on the slide table and held in sliding contact with respective surfaces of the cylinder tube outwardly of the first surfaces, respectively. The slide table may have grooves defined therein outwardly of the second surfaces and extending in a direction in which the slide table is displaceable, the other slide members being engaged in the grooves, respectively. Each of the other slide members may have one end bifurcated into at least two legs held in sliding contact with outer and inner areas of the cylinder tube outwardly of one of the second surfaces. The other slide members may be integrally formed with the slide members having the second surfaces.

The slide table may have a groove defined in a surface thereof which bears loads applied thereto, and a cover covering the groove, the cover being detachably mounted in the groove. The cover may have a locking finger removably disposed in a groove defined in the slide table for locking the cover in the groove. The cover may have a resilient member attached to the locking finger.

The separator may have projections projecting toward inner wall surfaces of the slit, each of the projections being spaced from the inner wall surface of the slit by a distance $L_1$ which is smaller than the distance $L_2$ by which the inner wall surface of the slit is spaced from a surface of the separator extending from the piston to the slide table. The separator may be integrally molded of a wear-resistant resin material.

The cylinder tube may have a groove defined in an outer side surface thereof and extending longitudinally thereof, further comprising a magnetic sensor disposed in the groove, the slide table being coupled to the piston, a pair of wear rings mounted on respective opposite ends of the piston, and a magnet disposed on an outer circumferential surface of at least one of the wear rings for activating the magnetic sensor. Magnets may be disposed on respective outer circumferential surfaces of the wear rings, one of the magnets being oriented toward a groove defined in an outer side surface of the cylinder tube, and the other magnet being oriented toward a groove defined in another outer side surface of the cylinder tube.

The rodless cylinder may also have a pair of end covers mounted on respective opposite ends of the slide table in a direction in which the slide table is displaceable, each of the end covers being composed of a body and a slide integral therewith and held in sliding contact with the second seal member, and a scraper mounted on each of the end covers in sliding contact with the second seal member.

According to the present invention, there is also provided a rodless cylinder comprising a cylinder tube, a piston movably disposed in the cylinder tube, a slide table coupled to the piston for movement therewith in a direction along the cylinder tube, and a floating mechanism mounted on the slide table for allowing displacements substantially perpendicular to the direction.

The floating mechanism may comprise a bracket fixed to the slide table and a joint having a workpiece support surface projecting upwardly of the bracket, the joint being coupled to the slide table by a pin for displacement substantially perpendicular to the direction. The bracket may have an upwardly projecting step, the bracket being fastened to the slide table to flex the step for holding the pin against wobbling movement.

The above and other objects, features, and advantages of the present invention will become apparent from the following description when taken in conjunction with the accompanying drawings which illustrate preferred embodiments of the present invention by way of example.

DESCRIPTION OF THE PREFERRED EMBODIMENTS

Figure 1:
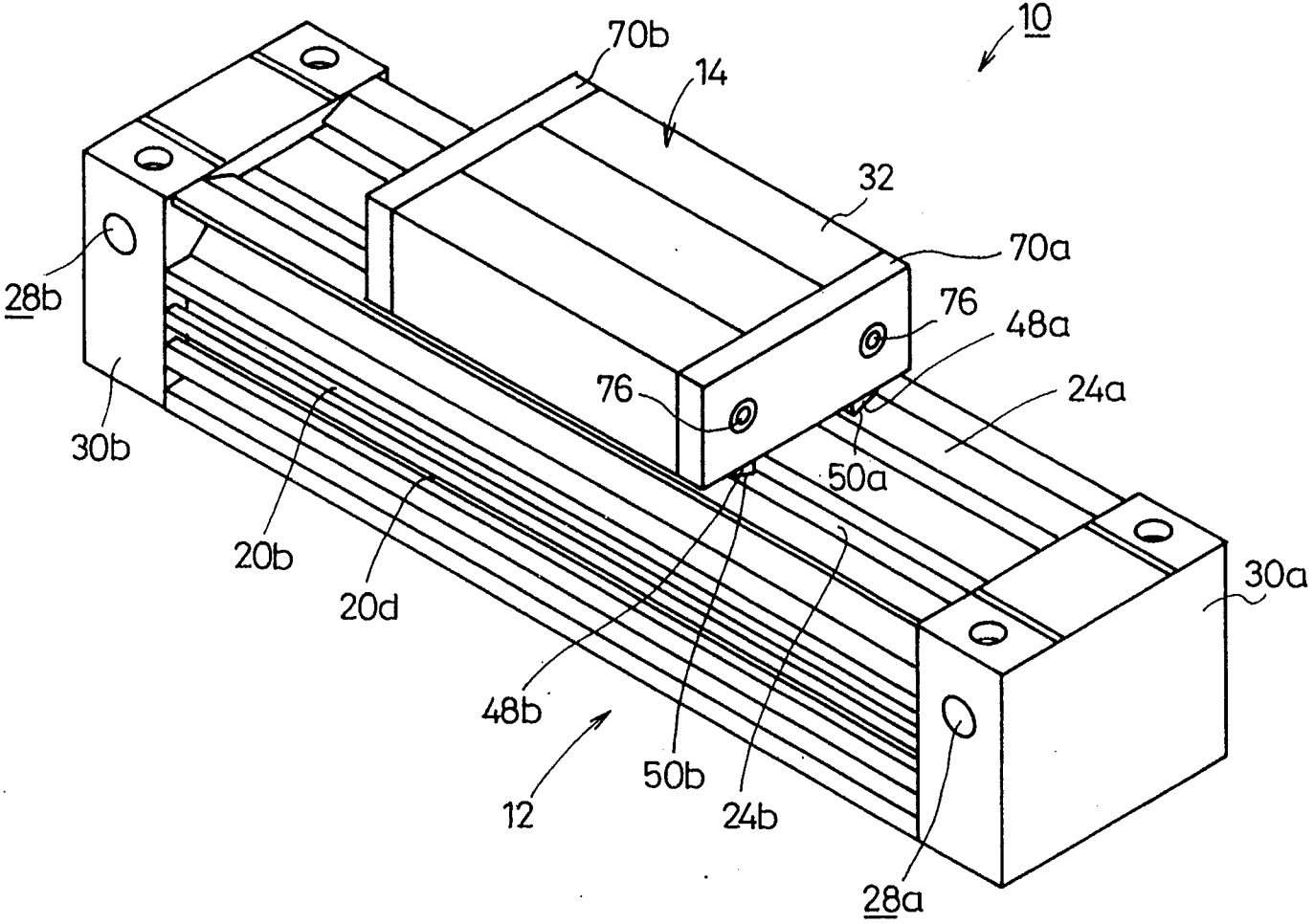
FIG. 1 is a perspective view of a rodless cylinder according to a first embodiment of the present invention.
Figure 2:
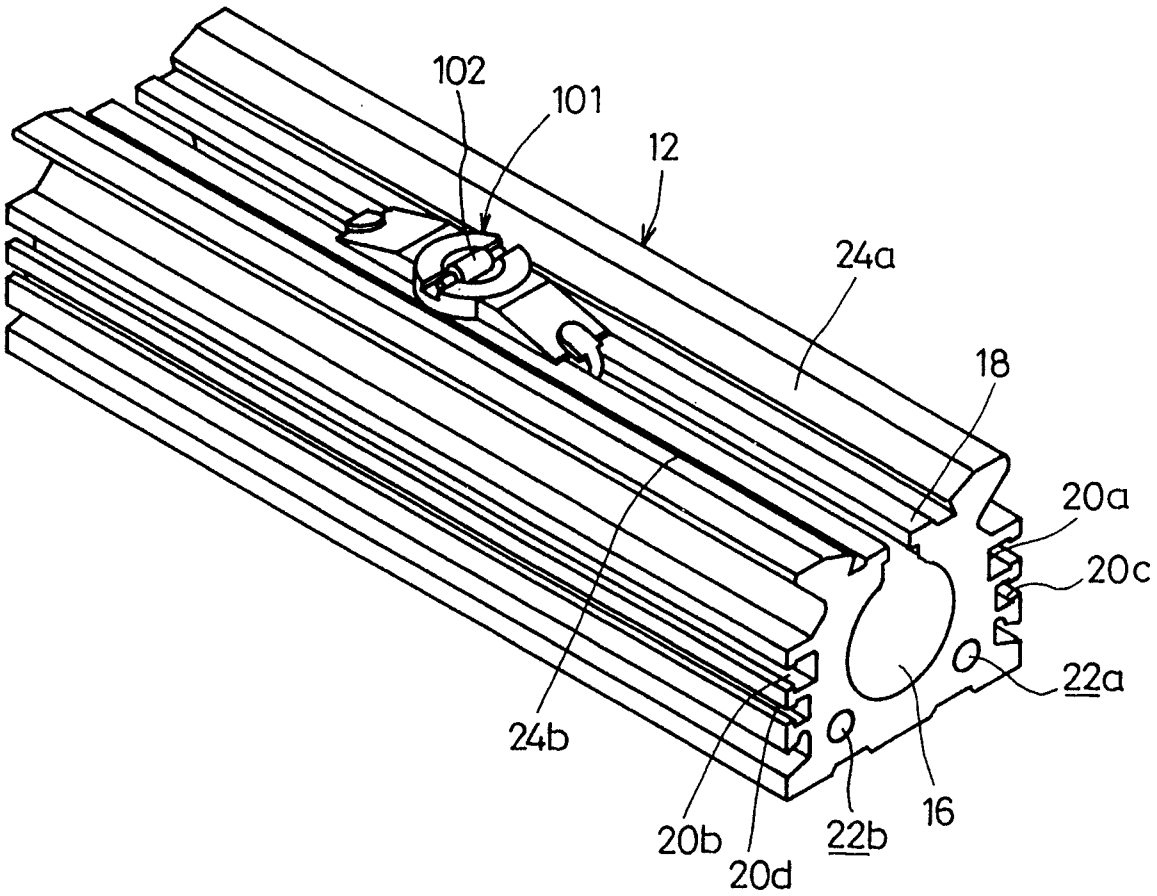
FIG. 2 is a perspective view of a cylinder tube of the rodless cylinder.
Figure 4:
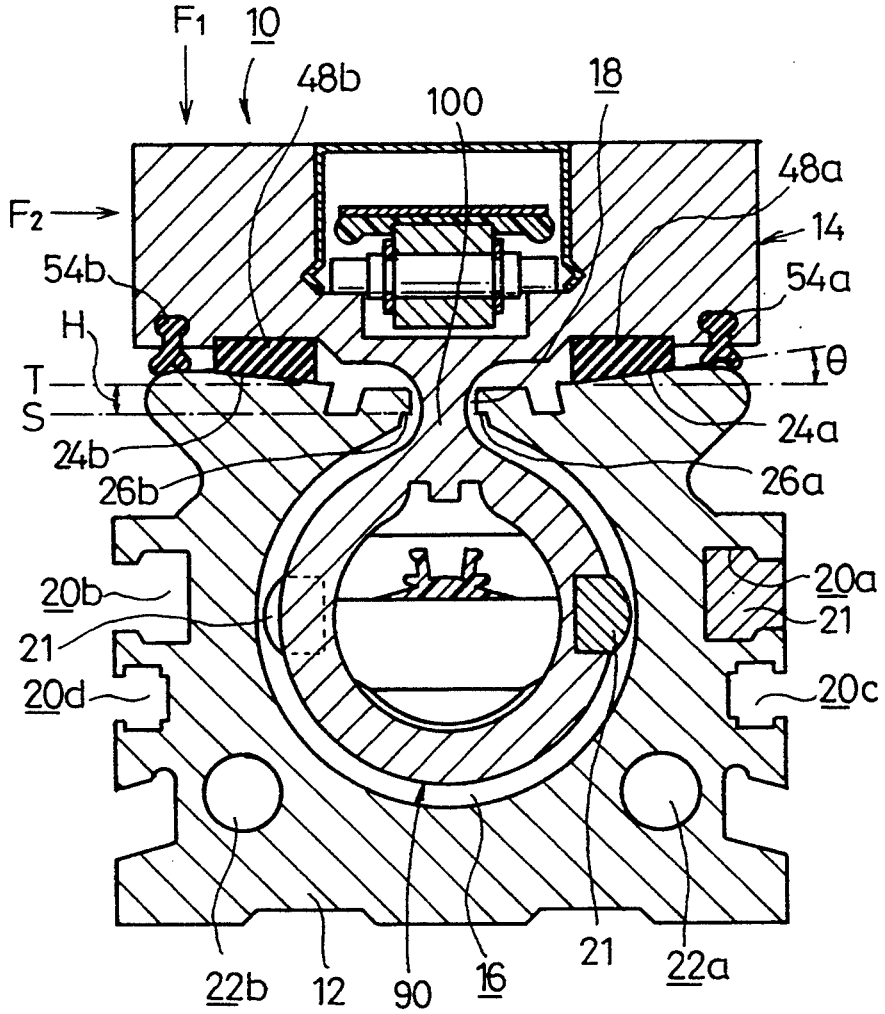
FIG. 4 is a vertical cross-sectional view of the slide table and the cylinder tube.

As shown in FIG. 1, a rodless cylinder, generally designated by the reference numeral 10, comprises a cylinder tube 12 and a slide table 14. The cylinder tube 12 has a bore 16 (see FIG. 2) defined therein which extends in the longitudinal direction thereof. The bore 16 communicates with the exterior space around the cylinder tube 12 through a slit 18 defined in an upper wall of the cylinder tube 12 and extending longitudinally therealong. The cylinder tube 12 has a pair of outwardly open sensor attachment grooves 20*a*, 20*b* and a pair of outwardly open wire containing grooves 20*c*, 20*d* defined in opposite side walls thereof and extending longitudinally therealong. A magnetic sensor 21 is disposed in either one of the grooves 20*a*, 20*b* for detecting the position of the slide table 14 by detecting a magnetic field from a magnet fitted in a ring-shaped wear ring of a piston, as described later on. In FIG. 4, the magnetic sensor 21 is mounted in the groove 20*a*.

As shown in FIG. 4, the cylinder tube 12 has a pair of first slide surfaces 24*a*, 24*b* on its upper wall which are positioned with one on opposite sides of a piston yoke 100 (described later on) and inclined upwardly an angle $\theta$ from the horizontal direction toward the slide table 14 radially outwardly of a piston 90 (also described later on). The first slide surfaces 24*a*, 24*b* start being inclined from the upper wall of the cylinder tube 12 at respective positions T that are vertically spaced a distance H from the lower end S of a vertical portion of the slit 18, i.e., upwardly away from the bore 16.

The slit 18 is defined between opposite side wall portions having respective steps 26*a*, 26*b* which are spread away from each other downwardly, i.e., toward the bore 16. The opposite side wall portions which define the slit 18 therebetween extend upwardly from the steps 26*a*, 26*b*, extend vertically, and then blend into the first slide surfaces 24*a*, 24*b*.

The opposite ends of the cylinder tube 12 are hermetically closed by respective end caps 30*a*, 30*b* (see FIG. 1) having respective ports 28*a*, 28*b*.

Figure 3:
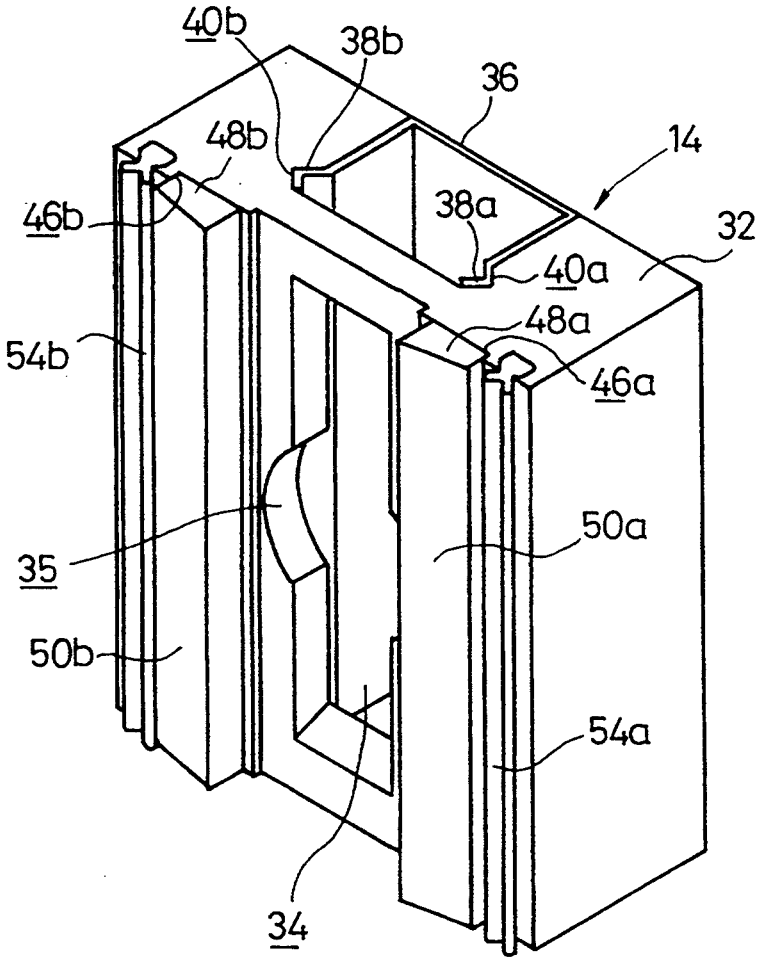
FIG. 3 is a perspective view of a slide table of the rodless cylinder.

The slide table 14 which is integral with the piston 90 will be described below. As shown in FIG. 3, the slide table 14 includes a table portion 32 having a groove 34 extending centrally therein in the longitudinal direction. The groove 34 includes an arcuate recess 34 in its central region. A cover 36 is disposed in an upper portion of the table portion 32.

Figure 5:
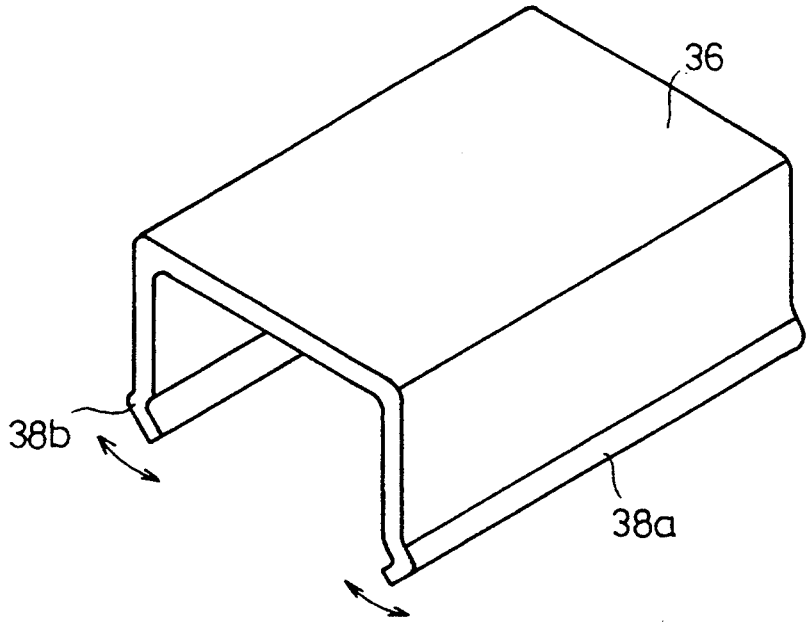
FIG. 5 is a perspective view of a cover to be mounted on the slide table.

As shown in FIG. 5, the cover 36 has a pair of locking fingers 38*a*, 38*b* extending longitudinally along respective edges thereof that are spaced from each other. The table portion 32 has a pair of recesses 40*a*, 40*b* defined in respective inner wall surfaces of the table portion 32 which are spaced from each other, the recesses 40*a*, 40*b* being complementary in shape to the locking fingers 38*a*, 38*b*.

The cover 36 is made of synthetic resin, for example. To assemble the cover 36 in the table portion 32, the cover 36 is inserted downwardly into the table portion 32 with the locking fingers 38*a*, 38*b* resiliently displaced toward each other by the inner wall surfaces of the table portion 32. At this time, the edges with the locking fingers 38*a*, 38*b* are resiliently displaced as indicated by the arrows in FIG. 5. The cover 36 is pushed into the table portion 32 until the locking fingers 38*a*, 38*b* snap into the respective recesses 40*a*, 40*b*. Therefore, the cover 36 can easily be placed and locked in the table portion 32. To remove the cover 36 from the table portion 32, the cover 36 is pulled upwardly. The locking fingers 38*a*, 38*b* are forced out of the recesses 40*a*, 40*b*. The cover 36 can thus be detached from the table portion 32 with ease.

Figure 6:
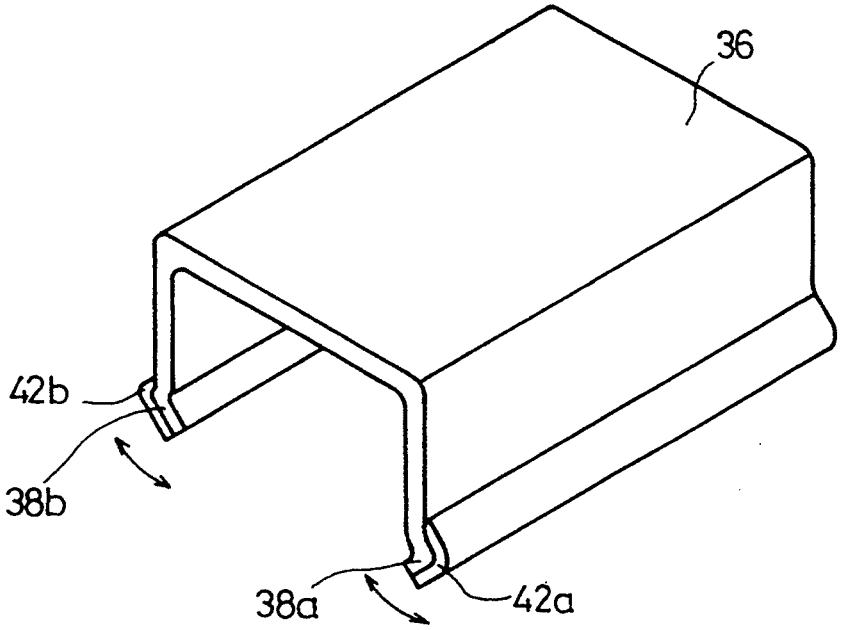
FIG. 6 is a perspective view of a cover according to another embodiment of the present invention.

As shown in FIG. 6, liners 42*a*, 42*b* of a resilient material such as synthetic resin or the like may be bonded to outer sides of the respective locking fingers 38*a*, 38*b*. When the locking fingers 38*a*, 38*b* are placed in the respective recesses 40*a*, 40*b*, the liners 42*a*, 42*b* are effective to keep the groove 34 hermetically sealed and drip-resistant.

The slide table 14 has a pair of grooves 46*a*, 46*b* defined in and extending longitudinally along the bottom surface thereof, the grooves 46*a*, 46*b* being positioned one on each side of the groove 34. First slide members 48*a*, 48*b* are fixedly disposed in the grooves 46*a*, 46*b*, respectively, for supporting the slide table 14 and allowing the slide table 14 to slide smoothly with respect to the first slide surfaces 24*a*, 24*b*. The first slide members 48*a*, 48*b* have respective second slide surfaces 50*a*, 50*b* slidably engaging the respective first slide surfaces 24*a*, 24*b* of the cylinder tube 12 for guiding the slide table 14 and bearing loads on the slide table 14 which act on the slide table 14 to prevent the bore 16 from changing its inside diameter while the piston 90 is moving back and forth. The first slide members 48*a*, 48*b* are made of a material which is highly resistant to wear and has a small frictional resistance, such as synthetic resin.

Figure 7:
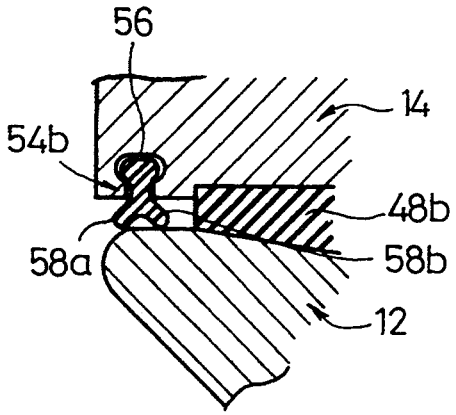
FIG. 7 is a fragmentary vertical cross-sectional view of a structure through which the slide table and the cylinder tube slidingly contact each other.

Between the slide table 14 and the cylinder tube 12, there are interposed second slide members 54*a*, 54*b* (see FIGS. 3 and 7) extending substantially parallel to the first slide members 48*a*, 48*b* and positioned outwardly of the first slide members 48*a*, 48*b*. The second slide members 54*a*, 54*b* have upper portions mounted in respective grooves 56 defined in the slide table 14 and lower portions each bifurcated into an outer leg 58*a* and an inner leg 58*b*. The outer and inner legs 58*a*, 58*b* of the second slide members 54*a*, 54*b* have tip ends slidably held against the first slide surfaces 24*a*, 24*b*. The outer legs 58*a* are effective to prevent external dust from entering the rodless cylinder 10 and the inner legs 58*b* are effective to prevent lubricating oil applied to the first slide members 48*a*, 48*b* from flowing out.

Figure 8:
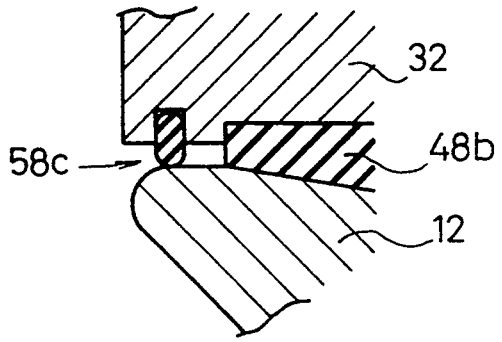
FIG. 8 is a fragmentary vertical cross-sectional view of a structure through which the slide table and the cylinder tube slidingly contact each other.
Figure 9:
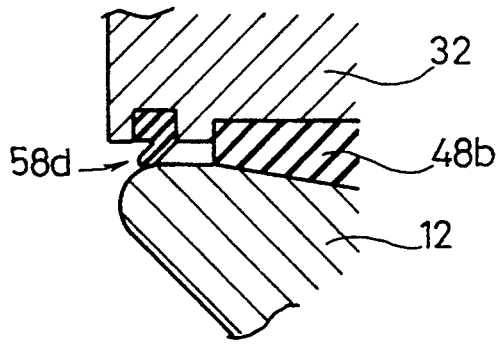
FIG. 9 is a fragmentary vertical cross-sectional view of another structure through which the slide table and the cylinder tube slidingly contact each other.
Figure 10:
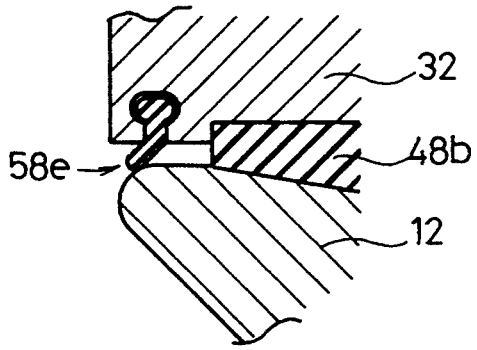
FIG. 10 is a fragmentary vertical cross-sectional view of still another structure through which the slide table and the cylinder tube slidingly contact each other.
Figure 11:
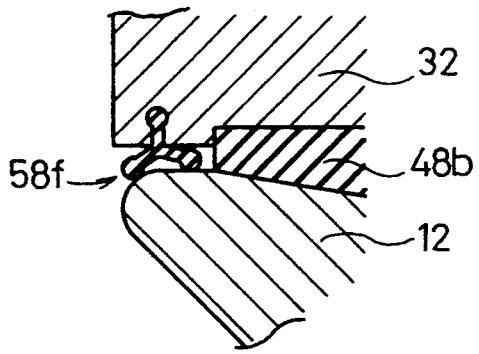
FIG. 11 is a fragmentary vertical cross-sectional view of yet another structure through which the slide table and the cylinder tube slidingly contact each other.
Figure 12:
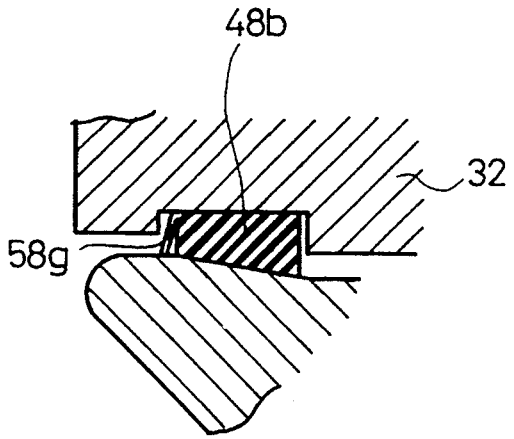
FIG. 12 is a fragmentary vertical cross-sectional view of a further structure through which the slide table and the cylinder tube slidingly contact each other.
Figure 13:
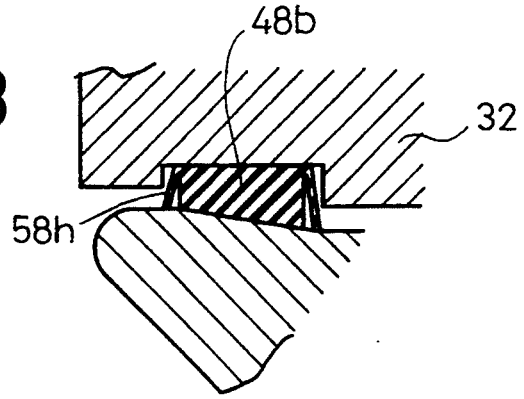
FIG. 13 is a fragmentary vertical cross-sectional view of a still further structure through which the slide table and the cylinder tube slidingly contact each other.

The second slide members 54*a*, 54*b* may have other transverse cross-sectional shapes. FIGS. 8 through 13 show different second slide members 58*c*, 58*d*, 58*e*, 58*f*, 58*g*, 58*h* having different transverse cross-sectional shapes. In FIG. 8, the second slide members 58*c* (only one shown) have curved edges held in sliding contact with the first sliding surfaces 24*a*, 24*b* of the cylinder tube 12. In FIGS. 9 through 12, the second slide members 58*d*, 58*e*, 58*f*, 58*g* have outwardly inclined portions held in sliding contact with the first sliding surfaces 24*a*, 24*b* of the cylinder tube 12. In FIGS. 12 and 13, the second slide members 58*g*, 58*h* have a reduced wall thickness.

Any one of the second slide members with different cross-sectional shapes may be selected to meet environments in which to use the rodless cylinder. Therefore, the areas of the second slide members through which they slidingly contact the first sliding surfaces 24a, 24b of the cylinder tube 12 may be selected for a smaller frictional resistance. In FIGS. 12 and 13, the second slide members 58g, 58h are integral with the first slide members 48a, 48b. In the structures shown in FIGS. 12 and 13, the table portion 32 is not required to have the grooves 56. With the second slide members 58g, 58h being integral with the first slide members 48a, 48b, the overall number of parts of the rodless cylinder is reduced, the structure thereof is simplified, and the cost thereof is lowered.

Figure 14:
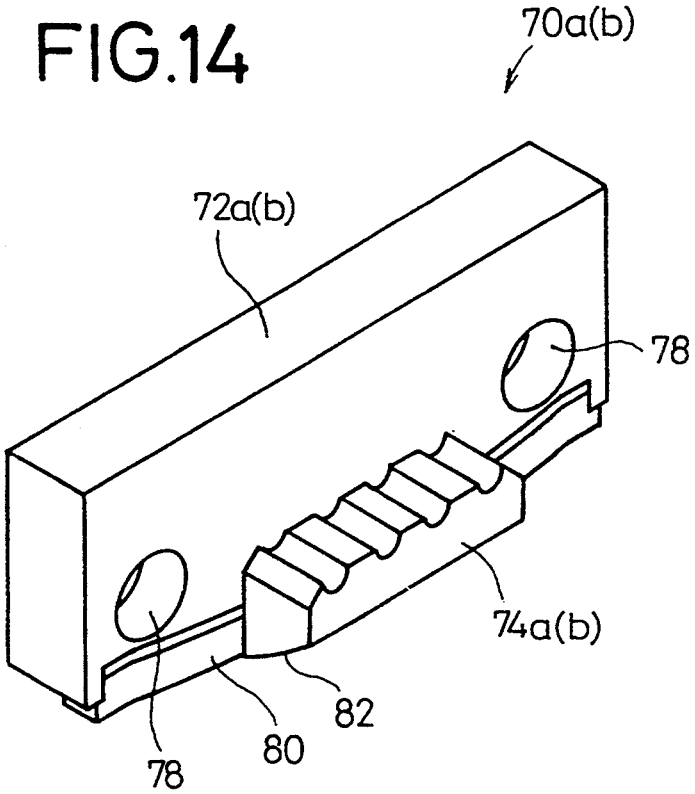
FIG. 14 is a perspective view of an end cover of the slide table.
Figure 15:
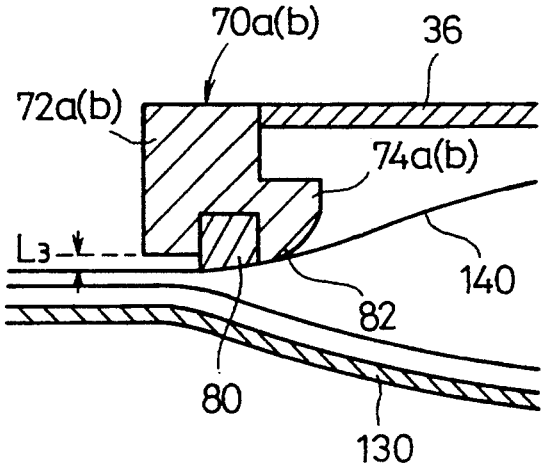
FIG. 15 is a fragmentary vertical cross-sectional view of the end cover shown in FIG. 4 and first and second seal members.

A pair of end covers 70a, 70b is attached to longitudinal front and rear ends, respectively, of the table portion 32. As shown in FIG. 14, the end covers 70a, 70b comprise respective bodies 72a, 72b and respective slides 74a, 74b which are integrally molded of synthetic resin or the like. Since the end covers 70a, 70b are substantially identical in shape to each other, only one of the end covers 70a will be described below. The body 72a of the end cover 70a has a pair of spaced attachment holes 78 through which the end cover 70a can be fastened to the table potion 72 by bolts 76 (see FIG. 1). A scraper 80 is mounted on the bottom of the body 72a for scraping off dust particles that have been deposited on the upper surface of a second seal member (described later on). As illustrated in FIG. 15, the bottom of the slide 74a has a slanted surface 82 that is inclined at a certain angle and held in sliding contact with the second seal member.

Figure 16:
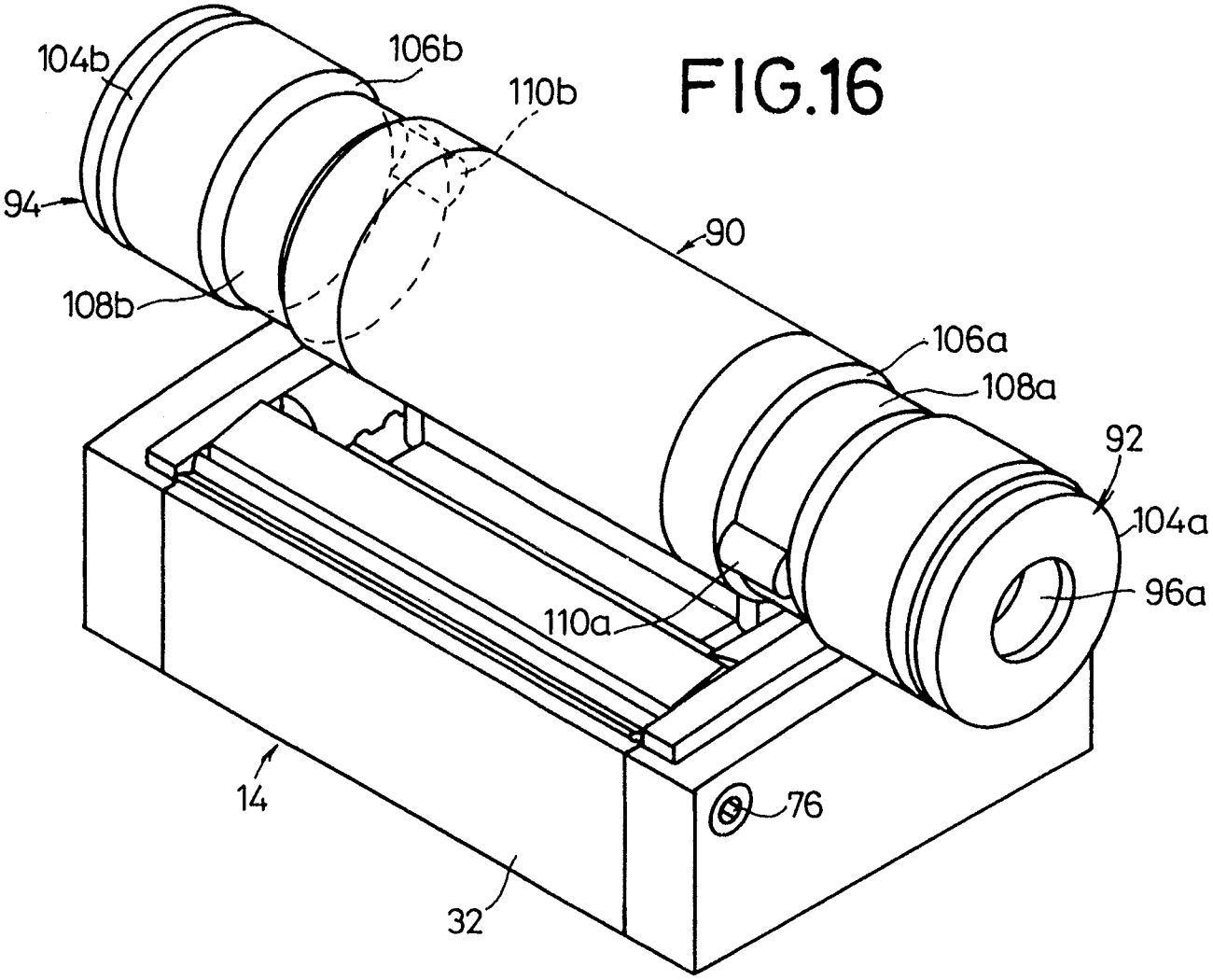
FIG. 16 is a perspective view of a piston and the slide table as they are assembled together.
Figure 17:
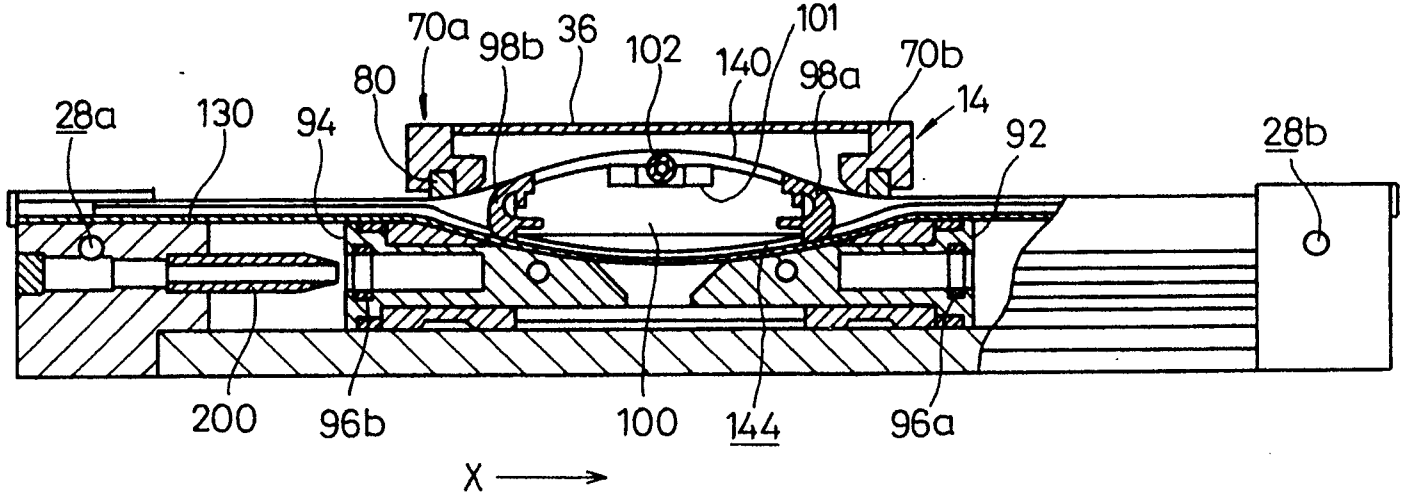
FIG. 17 is a vertical cross-sectional view of the rodless cylinder.

FIG. 16 shows the piston 90 that is integrally assembled with the slide table 14. The piston 90 has a first pressure-bearing surface 92 positioned in the vicinity of a piston packing 104a fitted over the piston 90 proper, and a second pressure-bearing surface 94 positioned in the vicinity of a piston packing 104b fitted over the piston 90 proper remotely from the piston packing 104a. As shown in FIG. 17, cushion seals 96a, 96b are disposed respectively inwardly of the first and second pressure-bearing surfaces 92, 94. Belt separators 98a, 98b are fixed to the piston yoke 100 which is positioned on an upper portion of the cylindrical piston 90. A roller 102 is rotatably supported on a circular coupler 101 (see FIG. 2) disposed above the piston yoke 100. The coupler 101 is fitted in the recess 35 of the slide table 14. The roller 102 is held in sliding engagement with the second seal member for allowing the slide table 14 to be easily fed while the slide table 14 is moving.

Figure 18:
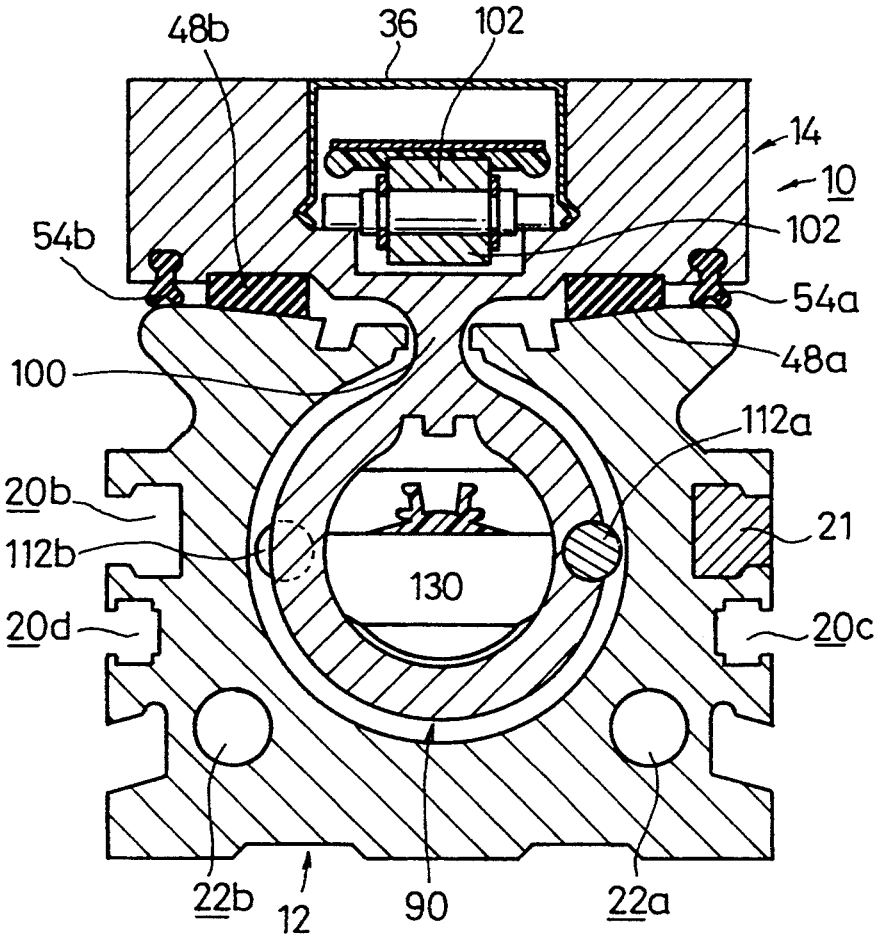
FIG. 18 is a vertical cross-sectional view of the slide table, the cylinder tube, and the piston with a modified magnet configuration.
Figure 19:
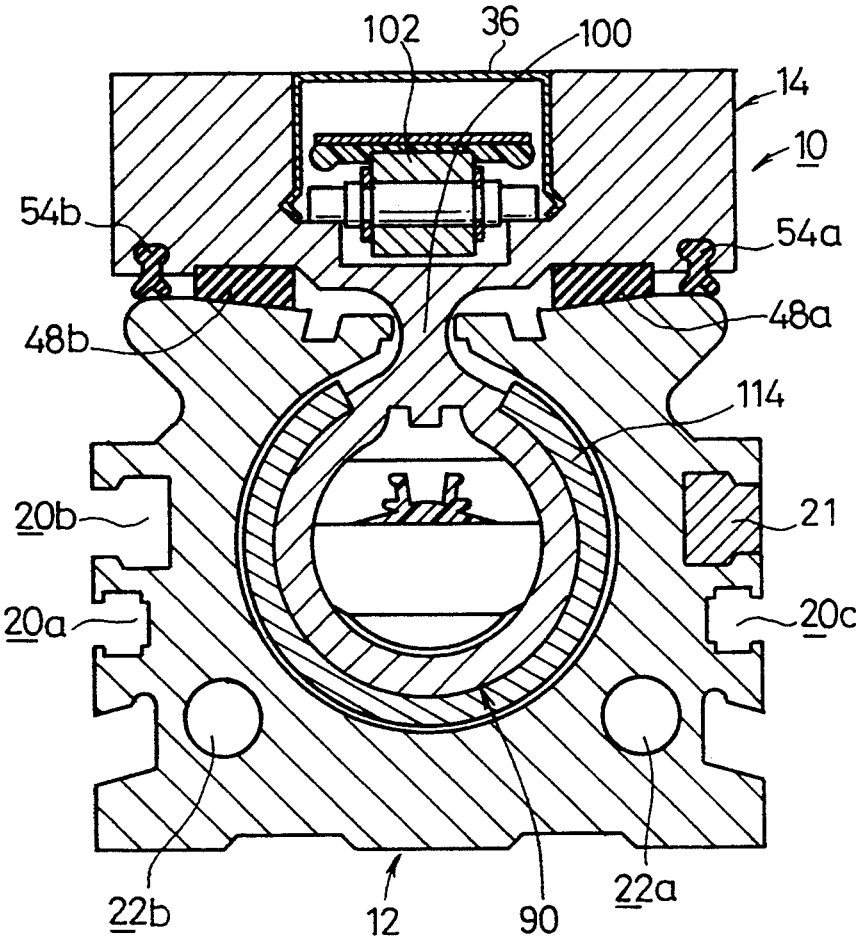
FIG. 19 is a vertical cross-sectional view of the slide table, the cylinder tube, and the piston with another modified magnet configuration.

As shown in FIG. 16, the piston packings 104a, 104b and wear rings (collars) 106a, 106b are mounted on the front and rear ends of the piston 90 near the piston yoke 100. The wear rings 106a, 106b have circular recesses 108a, 108b defined circumferentially therearound. Magnets 110a, 110b are fixedly mounted in the respective circular recesses 108a, 108b. The wear rings 106a, 106b are substantially identical in shape to each other, and the magnets 110a, 110b are assembled in the respective recesses 108a, 108b defined in the circumferential surfaces of the respective wear rings 106a, 106b. When the wear rings 106a, 106b combined with the magnets 110a, 110b are installed on the front and rear ends, respectively, of the piston 90, the magnets 110a, 110b on the respective wear rings 106a, 106b are oriented away from each other. The wear rings 106a, 106b serve to hold the magnets 110a, 110b as well as to perform their own function. The wear rings 106a, 106b are preferably integrally molded of synthetic resin such as polyacetal. As shown in FIG. 16, the magnets 110a, 110b have a substantially semicircular cross-sectional shape. However magnets 112a 112b of a substantially semicircular cross-sectional shape as shown in FIG. 18 may be employed, or alternatively, a single ring-shaped magnet 114 may be employed as shown in FIG. 19. Different lines of magnetic force may be produced by these different magnets 110a, 110b, 112a, 112b, 114.

Figure 20:
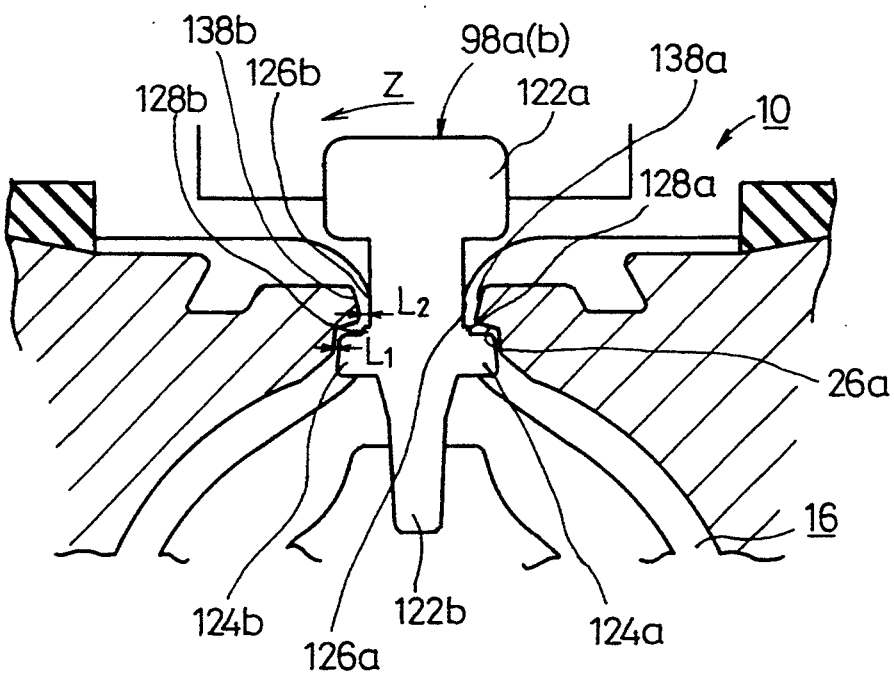
FIG. 20 is a fragmentary cross-sectional view showing the relationship between a belt separator and a slit in the rodless cylinder.
Figure 21:
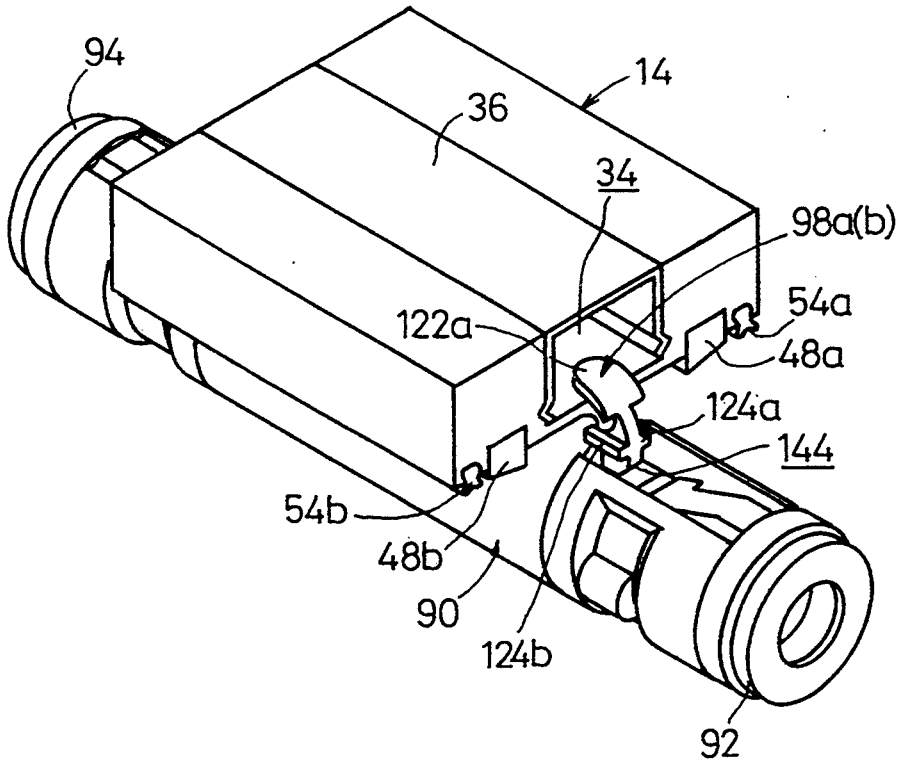
FIG. 21 is a perspective view of the piston and the slide table.

As described above, the belt separators 98a, 98b are mounted on the opposite ends, respectively, of the piston yoke 100. The belt separators 98a, 98b are integrally molded of a wear-resistant resin material. As shown in FIG. 20, the belt separators 98a, 98b have vertical arcuate slide surfaces 122a, 122b and arms 124a, 124b projecting laterally toward the inner wall surfaces which define the slit 18 of the cylinder tube 12. The arms 124a, 124b are spaced from the inner wall surfaces of the cylinder tube 12 by a distance $L_1$ which is smaller than the shortest distance $L_2$ between surfaces 126a, 126b of joints extending from the piston 90 to the slide table 14. Stiffener ribs 128a, 128b are disposed on proximal ends, respectively, of the arms 124a, 124b.

Figure 22:
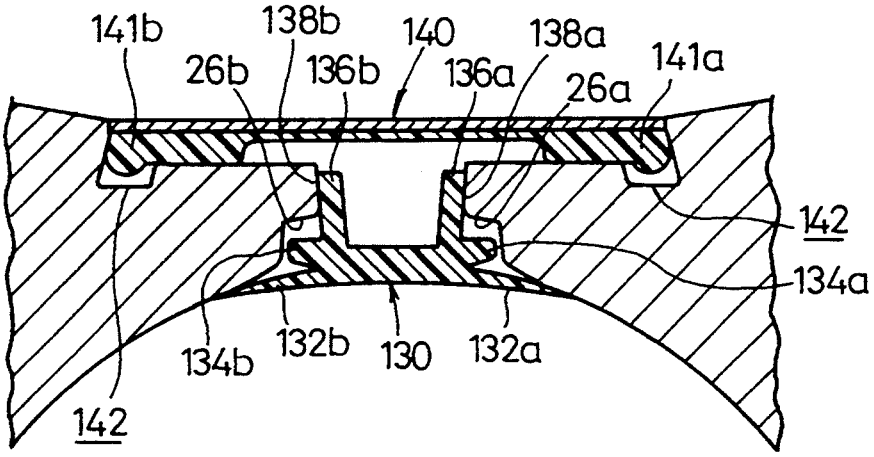
FIG. 22 is a fragmentary cross-sectional view showing the cylinder tube and a seal member as it is couple to the cylinder tube.

As shown in FIG. 22, a first seal member 130 is fitted in the steps 26a, 26b. The first seal member 130 has a pair of tongues 132a, 132b extending away from each other, a pair of projections 134a, 134b disposed above the tongues 132a, 132b and extending away from each other, and a pair of engaging arms 136a, 136b directed upwardly from the respective projections 134a, 134b and spreading slightly away from each other in the upward direction. When a pressure develops in the piston 90, the projections 134a, 134b engage the respective steps 26a, 26b. The engaging arms 136a, 136b engage inner surfaces 138a, 138b which define the slit 18 therebetween. The first seal member 130 is integrally molded of a flexible synthetic resin material. A second seal member 140, which is positioned over the slit 18 to close the slit 18, has a pair of synthetic resin bodies 141a, 141b extending along longitudinal opposite edges thereof and fitted in respective grooves 142 that are defined in the upper surface of the cylinder tube 12. The first seal member 130 enters a passage 144 for the piston 90, and has opposite ends which, together with the second seal member 140, are fixed to the respective end caps 30a, 30b. Cushion rings 200 (see FIG. 17) are fixed to the respective end caps 30a, 30b.

If necessary, a workpiece support plate 150 may be mounted on the slide table 14. A floating mechanism 152 used to feed a workpiece (not shown) through the workpiece support plate 150 will be described below.

Figure 23:
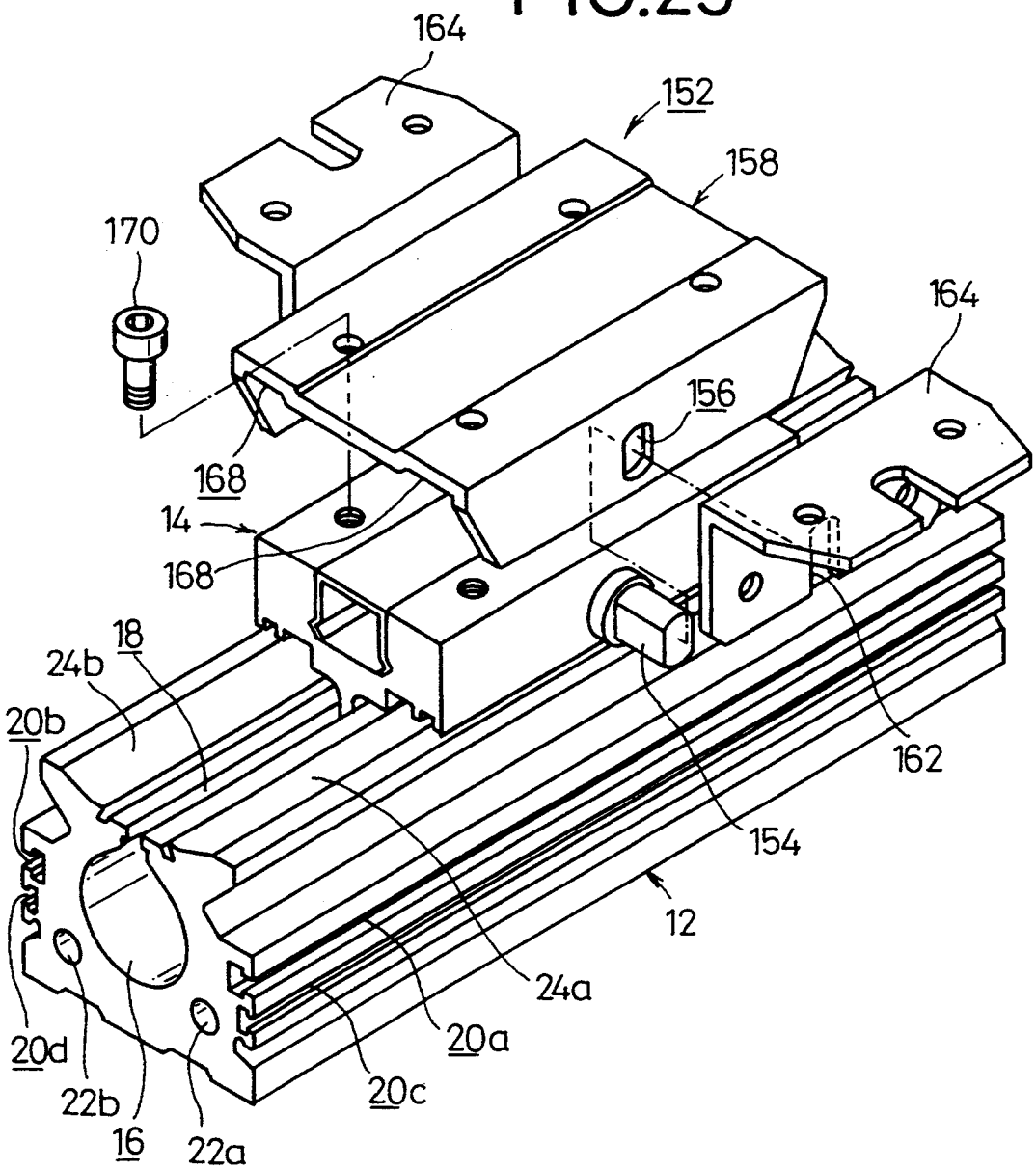
FIG. 23 is an exploded perspective view of a floating mechanism combined with the rodless cylinder.
Figure 24:
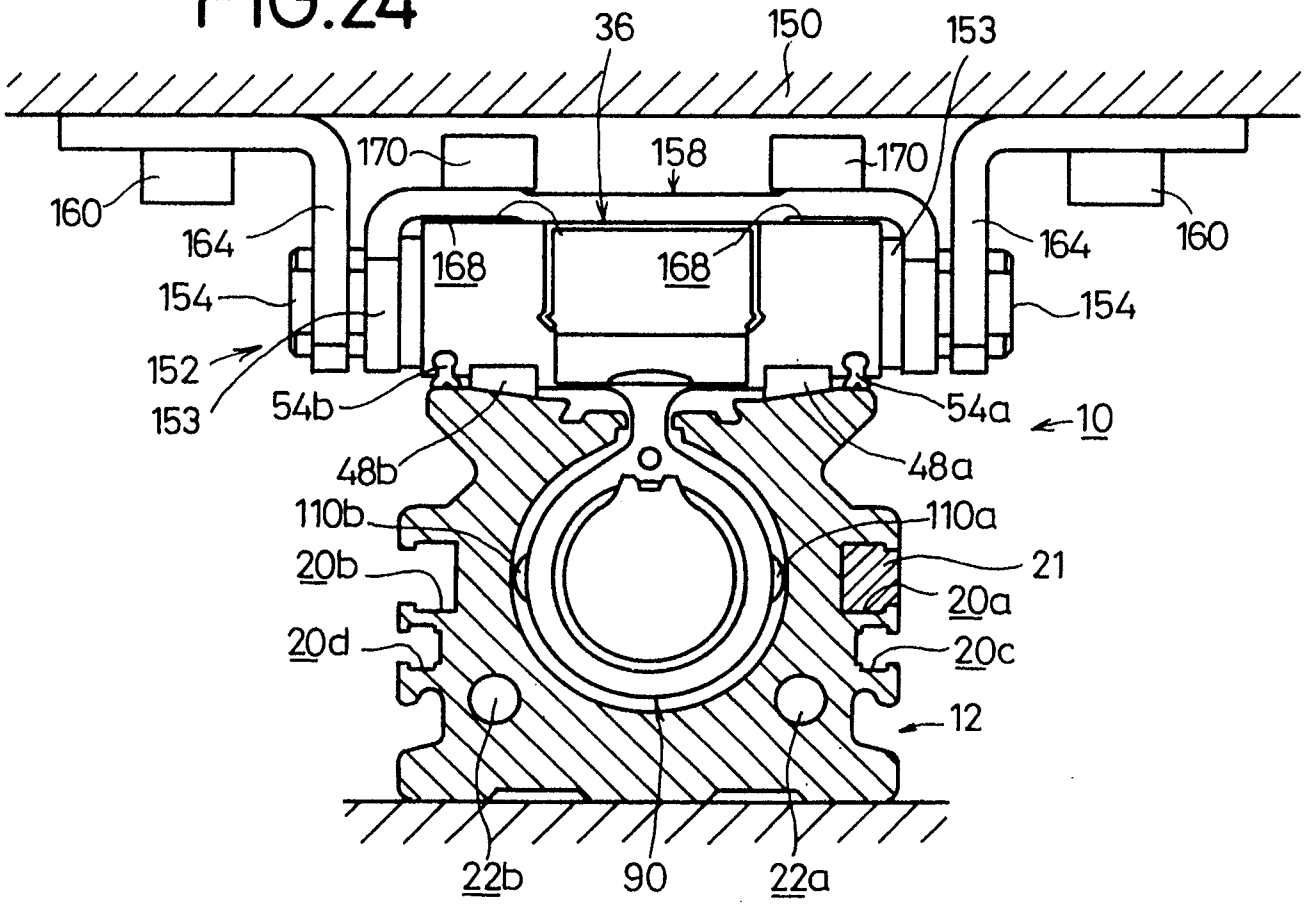
FIG. 24 is a vertical cross-sectional view of the floating mechanism combined with the rodless cylinder.

As shown in FIGS. 23 and 24, the floating mechanism 152 comprises a pair of pins 154 having flanges 153 detachably mounted on opposite sides of the slide table 14, a bracket 158 of substantially channel-shaped cross section which has holes 156 for the insertion of the pins 154 therethrough, and a pair of joints 164 of substantially L-shaped cross section each having a horizontal side panel coupled to the workpiece support plate 150 with screws 160 and a vertical side panel coupled to the pin 154 through a recess 162. The recesses 162 have upper ends that are normally positioned upwardly of the upper surfaces of the pins 154. The floating mechanism 152 serves to allow the workpiece support plate 150 mounted on the slide table 14 to be displaced with respect to the rodless cylinder 10.

The bracket 158 has steps 168 extending in the direction in which the slide table 14 is displaceable, the steps 168 being spaced a small gap 166 (see FIG. 24) from the upper surface of the slide table 14. The bracket 158 is fastened to the upper surface of the slide table 14 by screws 170. Since the vertical side panels of the joints 164 are removably attached in engagement with the pins 154 through the recesses 162, the joints 164 may be replaced with other joints of different shapes depending on the use of the workpiece support plate 150.

Figure 25:
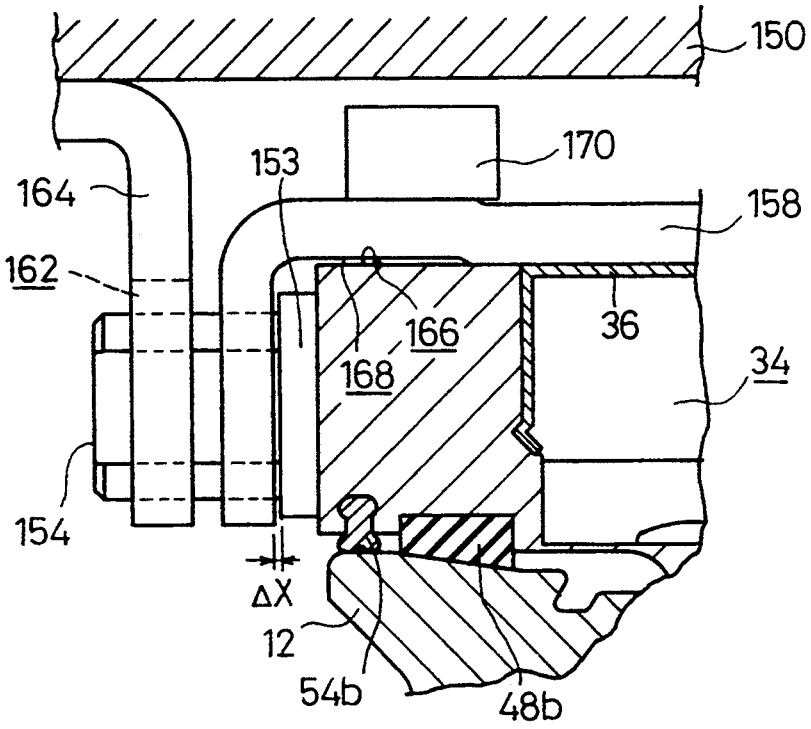
FIG. 25 is an enlarged fragmentary vertical cross-sectional view of the floating mechanism shown in FIG. 23.
Figure 26:
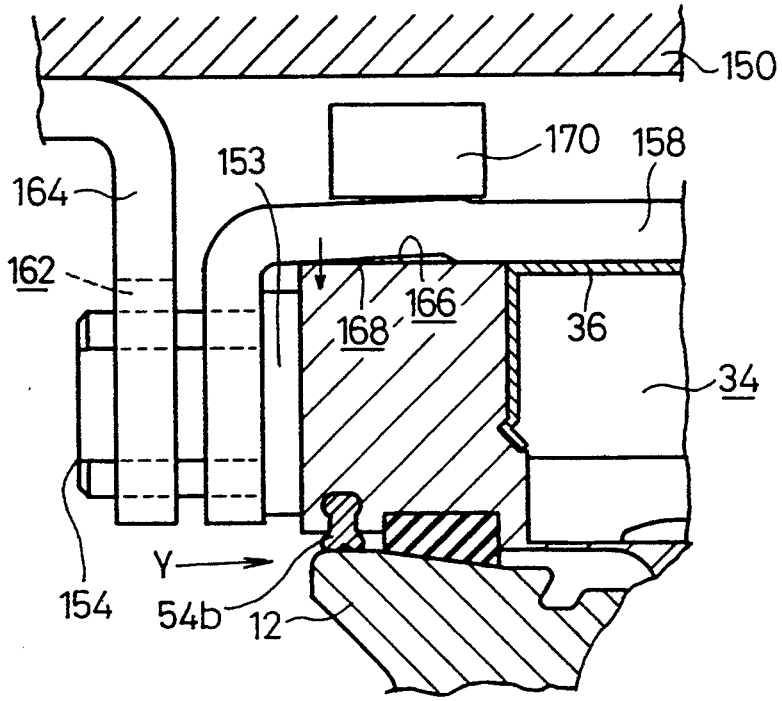
FIG. 26 is an enlarged fragmentary vertical cross-sectional view of the floating mechanism with a bracket and a slide table fastened to each other.

When the screws 170 by which the bracket 158 is secured to the slide table 14 are tightened from the position shown in FIG. 25 to the position shown in FIG. 26, the steps 168 are deformed toward the upper surface of the slide table 14. At this time, vertical sides of the bracket 158 are resiliently deformed in the direction indicated by the arrow Y, causing the flanges 153 to press the pins 154 against the slide table 14. Therefore, even if the bracket 158 has poor dimensional accuracy creating a small gap $\Delta X$ between the vertical sides of the bracket 158 and the pins 154 the gap $\Delta X$ can be eliminated preventing the pins 154 from wobbling when the vertical sides of the bracket 158 press the pins 154. In the illustrated embodiment, the pins 154 are inserted through the holes 156 of the bracket 158 so that the pins 154 may be detached from the bracket 158. However, the pins 154 may be screwed into the holes 158 of the bracket 158. In such a modification, the pins 154 are fixed to the vertical sides of the bracket 158, and when the vertical sides of the bracket 158 are resiliently deformed in the direction indicated by the arrow Y upon tightening the screws 170, the pins 154 are pressed against the slide table 14 and hence prevented from loosening from the bracket 158.

Operation of the rodless cylinder 10 will be described below.

When the rodless cylinder 10 is assembled in a factory or the like, the second seal member 140 placed under tension along the groove 34 of the table portion 32 in sliding contact with the roller 102. The second seal member 140 is tensioned between the end caps 30*a*, 30*b* without sagging along the longitudinal direction thereof. After the second seal member 140 has been installed, the end covers 70*a*, 70*b* are mounted on the respective opposite ends of the table portion 32. Since the bodies 72*a*, 72*b* and the slides 74*a*, 74*b* of the end covers 70*a*, 70*b* are integral with each other, when the end covers 70*a*, 70*b* are fastened to the table portion 32 by the bolts 76 inserted through the attachment holes 78, the bottom of the bodies 72*a*, 72*b* is spaced from the upper surface of the second seal member 140 by a distance $L_3$ (see FIG. 15). Thus, the condition in which the second seal member 140 slidingly contacts the slides 74*a*, 74*b*, which condition has heretofore been difficult to visually check, can directly be adjusted. As a result, the second seal member 140 can be held in slidingly contact with the slides 74*a*, 74*b* to lower any degradation of the second seal member 140 for a longer service life. Furthermore, inasmuch as sliding contact members are not required separately from the end covers 70*a*, 70*b*, the number of parts used is relatively small, and the rodless cylinder may be manufactured in a less costly manner. The condition in which the second seal member 140 slidingly contacts the slides 74*a*, 74*b* can be adjusted in servicing as well as when the rodless cylinder 10 is assembled.

Then, a workpiece is fixed to the surface of the table portion 32 of the slide table 14. In case the workpiece support plate 150 of the floating mechanism 152 is mounted on the slide table 14, the workpiece is secured to the surface of the workpiece support plate 150. Then, air is introduced under compression from the port 28*a* through a passage defined in the cushion ring 200 to press the second pressure-bearing surface 94. The piston 90 is now displaced to the right in FIG. 17 in the direction indicated by the arrow X, displacing the slide table 14 to the left as the roller 102 rotates.

Upon displacement of the slide table 14 along the first slide surfaces 24*a*, 24*b*, the scrapers 80 fixed to the bottom of the slide table 14 are also displaced. As the scrapers 80 are held in sliding contact with the upper surface of the second seal member 140, the scrapers 80 scrape off dust particles from the upper surface of the second seal member 140. Therefore, such dust particles are prevented from entering the slide table 14. The second slide members 54*a*, 54*b* are positioned outwardly of the first slide members 48*a*, 48*b* along the opposite outer edges of the slide table 14. These second slide members 54*a*, 54*b* are also effective in preventing dust from entering the slide table 14, and also preventing lubricating oil applied to the first slide members 48*a*, 48*b* from flowing out. Since dust particles are prevented from being applied to the first slide surfaces 24*a*, 24*b* between the first slide members 48*a*, 48*b* and the cylinder tube 12, the frictional resistance applied to the first slide members 48*a*, 48*b* is not increased, and the first slide members 48*a*, 48*b* are protected against damage. The second slide members 54*a*, 54*b* are preferably made of synthetic resin, rigid rubber, urethane, or the like. Thus, the second slide members 54*a*, 54*b* can be manufactured inexpensively. Upon reciprocating movement of the slide table 14, the lower ends of the second slide members 54*a*, 54*b* slidingly contact with the first sliding surfaces 24*a*, 24*b* of the cylinder tube through small areas. Therefore, the second slide members 54*a*, 54*b* do not substantially increase the resistance to the reciprocating movement of the slide table 14. In addition, since the grooves 56 through which the second slide members 54*a*, 54*b* are mounted on the slide table 14 may be formed when the slide table 14 is extrusion-molded, the second slide members 54*a*, 54*b* can simply be installed in place in the grooves 56, and the slide table 14 is not required to be machined separately for attachment of the second slide members 54*a*, 54*b*.

When the slide table 14 is displaced on the cylinder tube 12, the position of the slide table 14 is detected by the magnetic sensor 21 mounted in the groove 20*a* defined in the side of the cylinder tube 12. More specifically, the piston 90 integrally coupled to the slide table 14 is displaced with the movement of the slide table 14, and the magnetic sensor 21 detects a magnetic field produced by the magnets 110*a*, 110*b* disposed in the respective recesses 108*a*, 108*b* of the wear rings 106*a*, 106*b* mounted on the piston 90 for thereby detecting the position of the piston 90, i.e., the slide table 14. The magnetic sensor 21 supplies a detected signal through leads (not shown) disposed in the lead storage grooves 20*c*, 20*d* to an external device such as a controller (not shown).

When the workpiece is secured to the slide table 14 in FIG. 4, a vertical load F1 is applied to the slide table 14 by the workpiece. The applied vertical load F1 is effectively borne by the first sliding surfaces 24*a*, 24*b* of the cylinder tube 12 which engage the respective second slide surfaces 50*a*, 50*b* of the first slide members 48*a*, 48*b* fixed to the slide table 14. Specifically, the first sliding surfaces 24a, 24b and the second slide surfaces 50a, 50b are inclined at the angle $\theta$ toward the slide table 14 radially outwardly of the piston 90. Consequently, even when an unexpected load F2 is applied laterally to the slide table 14, the first slide surface 24a and the second slide surface 50a can effectively bear the applied unexpected load F2. This prevents the inside diameter of the bore 16 from being reduced and hence prevents the piston 90 from being stopped, a condition which has heretofore been experienced with conventional rodless cylinders.

The first sliding surfaces 24a, 24b and the second slide surfaces 50a, 50b double as a guide to guide the slide table 14 as it moves back and forth and as a bearing for bearing various loads such as the loads F1, F2. The rodless cylinder 10 is relatively simple in structure, and may be reduced in overall size and cost. The position T of the first slide surfaces 24a, 24b is spaced from the position S of the steps 26a, 26b in the vicinity of the slit 18 by the distance H in the direction (upward direction in FIG. 4) away from the bore 16. As a consequence, the slide table 14 may be reduced in overall thickness and simplified in shape.

External forces may be applied to the slide table 14 to tilt the slide table 14 in the direction indicated by the arrow Z, for example, in FIG. 20. To cope with this problem, the distance $L_1$ between the arms 124a, 124b of the belt separators 98a, 98b and the inner wall surfaces of the cylinder tube 12 is selected to be smaller than the distance $L_2$ between the surfaces 126a, 126b of the joints from the piston 90 to the slide table 14 and the inner wall surfaces of the cylinder tube 12. When the slide table 14 is tilted in the direction Z, therefore, the arms 124a of the belt separators 98a, 98b are brought into contact with the step 26a of the cylinder tube 12, preventing the surfaces 126b from contacting the inner surface 138b of the cylinder tube 12.

As the arms 124b made of a wear-resistant resin material slidingly contact the step 26a of the cylinder tube 12, the generation of particles worn off or seizure is prevented which would otherwise happen if the surfaces 126b contacted the inner surface 138b. Accordingly, even in the event that the slide table 14 is tilted in the direction Z or the direction opposite thereto, the piston 90 and the slide table 14 can smoothly move at all times.

The arms 124a, 124b may simply be formed integrally with the belt separators 98a, 98b of a wear-resistant resin material, and no dedicated wear-resistant mechanism is required. Thus, the rodless cylinder is relatively simple in structure, and the cost thereof is relatively low.

In the illustrated embodiment, the first slide members 48a, 48b, which are made of a material that is highly resistant to wear and has a small frictional resistance, are fixed to the slide table 14. However, metallic members, which are identical in shape to the first slide members 48a, 48b, may be coated with a synthetic resin material that is highly resistant to wear and has a small frictional resistance, on surfaces for engagement with the first slide surfaces 24a, 24b. It is also possible to fix slide members having first slide surfaces to the cylinder tube 12 and form second slide surfaces for engaging the first slide surfaces directly on the slide table 14.

In the case where the floating mechanism 152 is employed to feed a workpiece, it operates as follows: When the workpiece is placed on the workpiece support table 150, a load is applied to the workpiece support table 150 by the workpiece, and the workpiece support table 150 may be displaced substantially vertically. Upon such vertical displacement of the workpiece support table 150, the upper ends of the recesses 162 of the joints 164 are lowered until they engage the pins 154. Therefore, even when the workpiece support table 150 is subjected to an excessive load, the displacement thereof is permitted by the floating mechanism 152. The pins 154 are prevented from wobbling because they are pressed against the slide table 14 under the pressure from the vertical side walls of the bracket 158.

The rodless cylinder according to the present invention offers the following advantages: Even when the slide table suffers an excessive load, the inside diameter of the bore is prevented from being reduced, and the slide table and the piston are allowed to move smoothly without stoppage. Even under unexpected lateral forces applied, the inside diameter of the bore is effectively prevented from decreasing, preventing the piston from being stopped while the workpiece is being fed. Since only the first and second slide surfaces which engage each other are effective to ensure the smooth movement of slide table and the piston, the rodless cylinder is highly simple in structure, can be manufactured inexpensively, and may be reduced in size.

As the piston reciprocally moves in the bore in the cylinder tube, the slide table is displaced. The magnetic field that is generated by the magnets combined with the wear rings mounted on the respective opposite ends of the piston is detected by the magnetic sensor mounted in the groove of the cylinder tube for detecting the position of the piston with respect to the cylinder tube.

One of the magnets combined with the wear rings is oriented toward the groove in one side of the cylinder tube, and the other magnet is oriented toward the groove in the opposite side of the cylinder tube. Since the magnets are oriented away from each other, the piston may be inserted into the bore of the cylinder tube from either one of the ends thereof. Inasmuch as the direction in which the piston is inserted is not limited by the polarities of the magnets, the piston can be inserted without error, and hence the rodless cylinder can easily be assembled.

Because the magnets can easily be assembled around the wear rings, the piston is not required to be machined for supporting the magnets. As no special holders are necessary to hold the magnets, the number of parts of the rodless cylinder is relatively small, permitting the rodless cylinder to be manufactured at a relatively low cost.

The slide table has the groove defined therein which opens along the direction in which it is displaced, and the second seal member is guided along the groove. The groove is closed by the cover that is detachably mounted in place. When the cover is detached from the groove, the second seal member can easily be checked visually for its assembled condition when the rodless cylinder is assembled. Upon servicing the rodless cylinder, lubricating oil can easily be applied to the region where the second seal member and the roller slidingly contact each other.

When the piston reciprocally moves in the bore of the cylinder tube, the second seal member is guided along the groove of the slide table. The end covers each composed of the body and the slide for sliding contact with the second seal member are mounted on the opposite ends, respectively, of the slide table in the direction in which it is displaced. Therefore, the end covers may be spaced from the second seal member by a predetermined distance for adjusting the condition in which the second seal member slidingly contacts the end covers. Similarly, the spacing of the end covers from the second seal member makes it possible to adjust the condition in which the second seal member slidingly contacts the scrapers.

The locking fingers on the edges of the cover are securely locked in the grooves of the cylinder tube, and liners may additionally be attached to the locking fingers. Therefore, the locking fingers can hermetically seal the groove of the cylinder tube in which the piston is reciprocally movable.

The separators that separate the first and second seal members on the piston and slide table sides have the arms which are brought into contact with the inner wall surfaces of the cylinder tube when the slide table is tilted with respect to the cylinder tube. The inner wall surfaces of the cylinder tube are thus prevented from contacting metallic surface regions, with the result that the slide table can reciprocally move smoothly while effectively avoiding the generation of particles worn off or seizure. Since only the arms of the separators are used to prevent the inner wall surfaces of the cylinder tube from contacting metallic surface regions, the overall structure of the rodless cylinder is simplified, and the cost of the rodless cylinder is relatively low.

When the screws which fasten the bracket to the slide table are tightened in the floating mechanism, the steps of the bracket are resiliently deformed toward the upper surface of the slide table, and the vertical side walls of the bracket are resiliently deformed to press the pins against the slide table.

Therefore, even if the bracket has poor dimensional accuracy creating a small gap between the vertical sides of the bracket and the pins, the gap can be eliminated preventing the pins from wobbling. With the joints engaging the pins substantially in the vertical direction, the floating mechanism allows the workpiece support table to be displaced substantially vertically when it flexes under loads.

Since the pins are prevented from wobbling, the floating mechanism has a long service life. The bracket with the steps can easily be manufactured as the dimensional accuracy to which the vertical sides wall of the bracket are pressed to shape is not required to be high.

Although certain preferred embodiments of the present invention have been shown and described in detail, it should be understood that various changes and modifications may be made therein without departing from the scope of the appended claims.

What is claimed is:

1. A rodless cylinder comprising:

a cylinder having a cylinder tube with a bore defined therein and a piston reciprocally movably disposed in said bore;

said cylinder tube having a slit defined therein and extending longitudinally therealong, said slit communicating between said bore and an exterior space;

a slide table;

a first seal member engaging said piston;

a second seal member engaging said piston;

a second seal member engaging said slide table, said cylinder tube having a pair of retaining grooves disposed on respective opposite sides of said slit for receiving therein said second seal member;

said slit being closed by said first and second seal members;

said piston having a separator for separating said first and second seal members from each other;

said cylinder tube having a pair of slanted first surfaces positioned on respective opposite sides of said slit, and disposed outwardly from said retaining grooves with respect to said slit, said slanted surfaces being inclined upwardly away from said respective retaining grooves; and at least a pair of slide members disposed on said slide table and having respective second surfaces engaging said slanted first surfaces, respectively, for guiding said slide table when said piston reciprocally moves in said bore and bearing a load applied to said slide table.

2. A rodless cylinder according to claim 1, wherein said first surfaces are inclined from said slit toward said slide table, said second surfaces being inclined complementarily to said first surfaces.

3. A rodless cylinder according to claim 1 or 2, further comprising a pair of other slide members disposed outwardly of said slide members disposed on said slide table and held in sliding contact with respective surfaces of said cylinder tube outwardly of said first surfaces, respectively.

4. A rodless cylinder according to claim 3, wherein said slide table has grooves defined therein outwardly of said second surfaces and extending in a direction in which the slide table is displaceable, said other slide members being engaged in said grooves, respectively.

5. A rodless cylinder according to claim 4, wherein each of said other slide members has one end bifurcated into at least two legs held in sliding contact with outer and inner areas of said cylinder tube outwardly of one of said second surfaces.

6. A rodless cylinder according to claim 3, wherein said other slide members are integrally formed with said slide members having said second surfaces.

7. A rodless cylinder according to claim 1, wherein said slide table has a groove defined in a surface thereof which bears loads applied thereto, and a cover covering said groove, said cover being detachably mounted in said groove.

8. A rodless cylinder according to claim 7, wherein said cover has a locking finger removably disposed in a groove defined in said slide table for locking said cover in said groove.

9. A rodless cylinder according to claim 8, wherein said cover has a resilient member attached to said locking finger.

10. A rodless cylinder according to claim 1, wherein said separator has projections projecting toward inner wall surfaces of said slit, each of said projections being spaced from said inner wall surface of said slit by a distance $L_1$ which is smaller than a distance $L_2$ by which said inner wall surface of said slit is spaced from a surface of said separator extending from said piston to said slide table.

11. A rodless cylinder according to claim 10, wherein said separator comprises an integrally molded separator of a wear-resistant resin material.

12. A rodless cylinder according to claim 1, wherein said cylinder tube has a groove defined in an outer side surface thereof and extending longitudinally thereof, further comprising a magnetic sensor disposed in said groove, said slide table being coupled to said piston, a pair of wear rings mounted on respective opposite ends of said piston, and a magnet disposed on an outer circumferential surface of at least one of said wear rings for activating said magnetic sensor.

13. A rodless cylinder according to claim 12, wherein first and second magnets are disposed on respective outer circumferential surfaces of said wear rings, said first magnet being oriented toward a groove defined in an outer side surface of said cylinder tube, and the second magnet being oriented toward a groove defined in another outer side surface of said cylinder tube.

14. A rodless cylinder comprising:

a cylinder having a cylinder tube with a bore defined therein and a piston reciprocally movably disposed in said bore;

said cylinder tube having a slit defined therein and extending longitudinally therealong, said slit communicating between said bore and an exterior space;

a slide table;

a first seal member engaging said piston;

a second seal member engaging said slide table;

said slit being closed by said first and second seal members;

said piston having a separator for separating said first and second seal members from each other;

said cylinder tube having a pair of slanted first surfaces positioned on respective opposite sides of said slit;

at least a pair of slide members disposed on said slide table and having respective second surfaces engaging said slanted first surfaces, respectively, for guiding said slide table when said piston reciprocally moves in said bore and bearing a load applied to said slide table; and a pair of end covers mounted on respective opposite ends of said slide table in a direction in which the slide table is displaceable, wherein each of said end covers comprises a body and a slide integral therewith and held in sliding contact with said second seal member, and wherein a scraper is mounted on each of said end covers in sliding contact with said second seal member.

15. A rodless cylinder comprising:

a cylinder tube;

a piston movably disposed in said cylinder tube;

a slide table coupled to said piston for movement therewith in a direction along said cylinder tube; and a floating mechanism mounted on said slide table for allowing displacements substantially perpendicular to said direction, wherein said floating mechanism comprises a bracket fixed to said slide table and a pair of joints having workpiece support surfaces projecting upwardly of said bracket, said joints being coupled to said slide table by respective pins, and wherein said workpiece support surfaces are displaced substantially perpendicularly to said direction.

16. A rodless cylinder according to claim 15, wherein aid bracket has at least one upwardly projecting step projecting above said slide table, said bracket being fastened to said slide table such that said step is flexible downward toward said slide table, and such that said bracket is compressed toward said slide table for holding said pins against said slide table and preventing wobbling movement of said pins.

* * * * *